US005782630A

United States Patent [19]

Dane

[11] Patent Number: 5,782,630

[45] Date of Patent: Jul. 21, 1998

[54] ATMOSPHERE-CONTROL PILOT BURNER FOR A GAS APPLIANCE

[75] Inventor: Bernard Dane, Montbazon, France

[73] Assignee: Sourdillon, France

[21] Appl. No.: 775,095

[22] Filed: Dec. 30, 1996

[30] Foreign Application Priority Data

Jan. 5, 1996 [FR] France ..... 96 00090

[51] Int. Cl.[6] ..... F23D 14/62

[52] U.S. Cl. ..... 431/355; 431/349; 239/419.5

[58] Field of Search ..... 431/355, 354, 431/349; 48/180.1; 239/419.5, 538, 579

[56] References Cited

U.S. PATENT DOCUMENTS

| | | | |
|---|---|---|---|
| 478,364 | 7/1892 | Reimann | 431/355 |
| 1,978,477 | 10/1934 | Robertson | 431/349 |

FOREIGN PATENT DOCUMENTS

| | | | |
|---|---|---|---|
| 2149071 | 3/1973 | France . | |
| 2 609 158 | 7/1988 | France . | |
| 28295 | 2/1884 | Germany | 431/355 |
| 663538 | 7/1938 | Germany | 431/355 |
| 754265 | 8/1956 | United Kingdom | 431/355 |

*Primary Examiner*—Carl D. Price
*Attorney, Agent, or Firm*—Larson & Taylor

[57] ABSTRACT

Atmosphere-control pilot burner (1) for controlling the operation of a gas appliance automatically, which includes a body (2) defining a mixing chamber (3); a gas injector (4) emerging in the mixing chamber (3); a port (5) made in the wall of the body (2) for the intake of primary air into the mixing chamber (3), and a tube (7) which is fastened to the body and has a first end (8) connected coaxially to the mixing chamber (3) opposite the injector (4) and a second end (9) defining a flame orifice of the pilot burner, characterized in that the second end (9) of the tube (7) is shaped in order to have an auxiliary orifice (14) located laterally with respect to the main-flame orifice of the pilot burner and intended to generate a pilot flame in the vicinity of the root of the main flame.

8 Claims, 1 Drawing Sheet

ATMOSPHERE-CONTROL PILOT BURNER FOR A GAS APPLIANCE

FIELD OF THE INVENTION

The present invention relates to improvements made to atmosphere-control pilot burners intended to control the operation of a gas appliance automatically, including:

- a body defining a mixing chamber;
- a gas injector emerging in the mixing chamber;
- a port made in the wall of the body for the intake of primary air into the mixing chamber; and
- a tube which is fastened to the body and has a first end connected coaxially to the mixing chamber opposite the injector and a second end constituting a pilot-burner flame orifice, means for fixing the tube to the body which are suitable for allowing an adjustable angular orientation of the bevelled orifice with respect to the port.

BACKGROUND OF THE INVENTION

Atmosphere-control pilot burners for gas appliances of the aforementioned type are already known. However, the known pilot burners have certain drawbacks.

A major drawback stems from the fact that the level of intake of primary air is predetermined at construction, depending on the desired trigger threshold of the pilot burner (that is to say on a maximum level of $CO_2$ present in the ambient atmosphere, above which level the pilot burner triggers the shut-down in the operation of the gas appliance) and on the gas used. This predetermination based solely on the geometry of the elements of the pilot burner is therefore relatively approximate and varies substantially from one pilot burner to another. Furthermore, this purely constructional predetermination does not allow easy adaptation to various conditions and it is necessary to provide different variants in order to satisfy the various requirements. This results in a major difficulty in ensuring high-volume manufacture and the cost of the pilot burners is adversely affected thereby.

SUMMARY OF THE INVENTION

The object of the invention is essentially to provide an improved design of pilot burner which better meets the various practical requirements, and which in particular allows manufacture in very high volume while at the same time making it possible to cover various conditions of use, and which uses as small a number of component parts as possible, so that ultimately it is possible to reduce the cost of manufacture of the pilot burners substantially, while at the same time giving them more effective operating conditions.

For these purposes, an atmosphere-control pilot burner, as defined in the preamble, is essentially characterized, being designed in accordance with the invention, in that the first end penetrates into the mixing chamber and includes a bevelled inclined-edged orifice which is located substantially opposite the primary-air intake port.

By virtue of such a design, it is possible, while giving the tube a suitable angular orientation, for the primary-air intake to be finely adjusted depending on the pressure of the ambient atmosphere. The trigger threshold of the pilot burner may thus be set simply. The level of air intake is a maximum when the bevelled orifice faces the port in the wall of the body and is a minimum when the bevelled orifice is turned away from the said port.

Such a design uses only basic components (the body provided with its port and the tube fastened to the body) and excludes having to use auxiliary components, such as a closure member, a bimetallic strip, connecting elements, etc. Furthermore, the bevelled shape of the end of the tube is simple to produce. This results in a substantial saving in the manufacturing cost, while at the same time the method of operation of the pilot burner is made more reliable.

In a simple manner, the means of fixing the tube to the body comprise a borehole made coaxially in the body opposite the gas injector, into which borehole the tube is forcibly inserted in its required angular orientation. In addition, provision may be made for the tube to be formed from a metal blank rolled edge-to-edge.

It is also of interest for the extreme part of the edge of the bevelled orifice to be extended by a peg which projects longitudinally and forms a stop for the insertion of the tube into the borehole in the body, so that the bevelled orifice is correctly positioned, longitudinally, opposite the primary-air intake port; this thus ensures precise mounting and repetitive operating conditions while still remaining within the context of high-volume manufacture.

It is also of interest to provide for the above-mentioned second end of the tube to be shaped in order to have an auxiliary orifice located laterally with respect to the main-flame orifice of the pilot burner and intended to generate a pilot flame in the vicinity of the root of the main flame: the pilot flame heats the root of the main flame and therefore stabilizes the latter, allowing stable operation even during start-up of the appliance. This stability contributes fundamentally to precise and repetitive triggering of the pilot burner at the appearance of a predetermined $CO_2$ level.

In one particularly advantageous embodiment, the auxiliary orifice is annular and surrounds the main orifice. Thus the root of the main flame is heated homogeneously, which contributes to the stability of this main flame. Furthermore, from a structural standpoint, this design proves to be simple to realize in a practical way since in this case the second end of the tube may include a coaxial tubular insert separated radially from the wall of the tube, the central orifice of the insert constituting the abovementioned main-flame orifice of the pilot burner and the annular space between the insert and the tube constituting the annular pilot-flame orifice.

Finally, the operation of the pilot burner may be adapted for a given gas by selecting an insert of suitable diameter from an assortment of inserts having diameters determined respectively for various types of gases.

By virtue of the arrangements specific to the invention, not only does the pilot burner offer advantages in setting the trigger threshold and in the precision and repeatability of the threshold, advantages which the prior pilot burners did not possess, but also there is a reduced number of component parts (a body, a tube and an insert) and the assembly of the parts is simple since it may be achieved simply by fitting them together: it is therefore possible to reap the benefit of a substantial reduction in the manufacturing cost.

BRIEF DESCRIPTION OF THE DRAWINGS

The invention will be more clearly understood on reading the detailed description which follows of a preferred embodiment given solely by way of non-limiting example. In this description, reference is made to the appended drawings in which.

DESCRIPTION OF THE PREFERRED EMBODIMENTS

Figure 1:
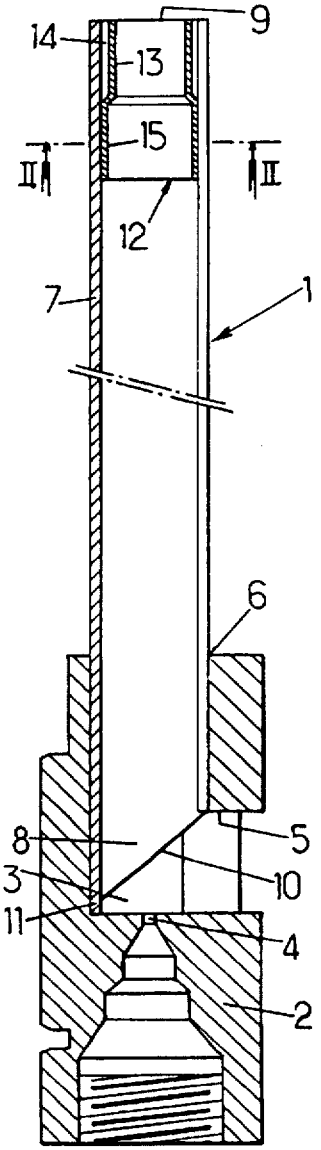
FIG. 1 is a sectional view of a pilot burner designed in accordance with the invention.

First of all referring to FIG. 1, a pilot burner in accordance with the invention, designated in its entirety by the reference 1, includes a body 2 provided with an internal recess constituting a mixing chamber 3. A calibrated borehole 4 constituting a gas injector emerges in this chamber, the borehole 4 being shaped towards the external face of the body 2 so as to be able to be connected to a gas inlet pipe (not shown).

The side wall of the body 2 delimiting the chamber 3 is drilled with a port 5 forming the opening for intake of primary air.

Opposite the gas injector 4, and coaxially with it, the mixing chamber 3 has a bore 6 in which a tube 7 is engaged by one of its ends 8 (the first end). The opposite end 9 (the second end) of the tube constitutes the main-flame orifice of the pilot burner.

The first end 8 of the tube 7 includes an orifice with a bevelled inclined edge 10 and located substantially opposite the port 5. Provided at the most extreme part of the edge 10 is a peg 11 which projects longitudinally and which serves as a stop for the longitudinal positioning of the tube against the wall of the chamber 3 in which the injector 4 emerges.

The tube 7 is mounted in the bore 6 by fixing means suitable for allowing an adjustable angular orientation of the bevelled orifice 10 with respect to the port 5. The fixing means may be of any type known to the person skilled in the art in order to obtain the desired effect. In the example shown in FIG. 1, the tube 7 is forcibly fitted, the tube being slit longitudinally at least in this first end 8 and being applied elastically in the bore 6. In practice, the tube 7 consists of a rectangular metal plate rolled up on itself, the abutting edges of which leave a gap 7*a* so that the tube can deform elastically for the purpose of the required fitting operation.

By virtue of this design, it is possible, by giving the tube 7 a predetermined angular orientation when mounting it in the body 2, and therefore by locating the bevelled orifice 10 in a predetermined angular position with respect to the port 5, to set the level of primary air mixed with the gas leaving the injector 4.

Figure 3A:
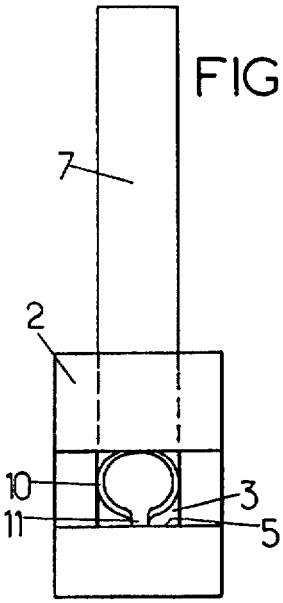
FIGS. 3A to 3C are three highly diagrammatic views illustrating respectively three mounting positions of the tube in the pilot burner of FIG. 1.

In FIG. 3A, the inclined-edged opening 10 of the tube 7 is turned completely towards the port 5 (the orientation shown also in FIG. 1): the level of primary air admitted into the air-gas mixture is then a maximum.

Figure 3B:
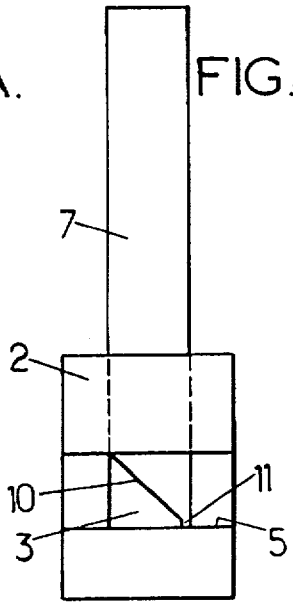
Figure 3C:
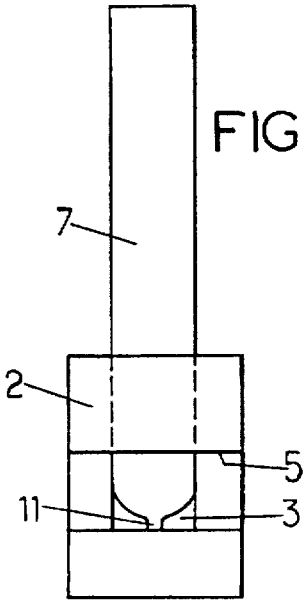

In FIG. 3C, the tube is turned through 180° with respect to the above position and the inclined-edged opening 10 is directed away from the port 5: the level of primary air admitted into the air-gas mixture is then a minimum.

For any intermediate angular orientation between the two above orientations, the level of primary-air intake is set to a value intermediate between the maximum and the minimum: in FIG. 3B, the tube is turned through 45° with respect to the position in FIG. 3A and the level of primary-air intake is set to a moderate value.

The simple means which have just been described allow the trigger threshold of the pilot burner to be set precisely depending on the required operating conditions (type of gas appliance, type of gas used, value of the trigger threshold).

However, the precision in the triggering of the pilot burner for a predetermined threshold, as indicated hereinabove, remains secondary to the stability of the pilot-burner flame existing at the second end 9 of the tube 7. It is therefore fundamental to ensure effective stabilization of the main flame, this stabilization being achieved, in accordance with the invention, by a suitable design of the second end 9 of the tube.

For this purpose, an auxiliary orifice, which is intended to generate a pilot flame in the vicinity of the root of the main flame, is located laterally with respect to the main orifice. In a manner known per se, this pilot flame heats the root of the main flame and therefore provides the desired stability of the latter. This stabilization facilitates cold start-up of the pilot burner.

The action of the pilot flame is improved if it heats the entire periphery of the root of the main flame homogeneously: for this purpose, it is therefore advantageous for the pilot flame to be annular and to surround the root of the main flame. It is therefore envisaged employing an auxiliary orifice of annular shape which surrounds the main orifice provided at the end 9 of the tube 7.

Figure 2:
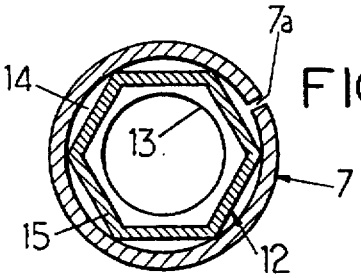
FIG. 2 is a view on a larger scale, in section on the line II—II in FIG. 1.

In a simple and easily manufacturable embodiment shown in FIGS. 1 and 2, a coaxial tubular insert 12 is inserted into the end 9 of the tube 7, the side wall 13 of this insert being separated, radially inwards, from the wall of the tube 7 and defining with the latter an annular space 14 constituting the abovementioned annular auxiliary orifice. At its base 15, the insert may have a polygonal, for example hexagonal, contour and be forcibly inserted into the end 9 of the tube 7: the end 9 of the tube, which is a cylinder of revolution, and the polygonal base 15 of the insert leave passages between them for the inflammable mixture generating the pilot flame.

The flow area defined by the annular space 14 must be adjusted to a predetermined value for each type of gas liable to be employed by the gas appliance. In order to make this adjustment, an insert of the diameter required for the gas used, chosen from a set of inserts having diameters preselected respectively for the various gases which may be used, is put into position.

It will consequently be appreciated that the pilot burner in accordance with the invention consists of an extremely small number of parts, namely three component parts (the body 2, the tube 7 and the insert 12), among which there is no part which moves or deforms during operation of the pilot burner. Such a pilot burner therefore has a low manufacturing cost and a high reliability.

Furthermore, the means employed enable the trigger threshold of the pilot burner to be set precisely and the triggering occurs in a precise and repetitive manner for the predetermined threshold.

I claim:

1. An atmosphere-control pilot burner which burns a gas mixed with primary air and which has an adjustable trigger threshold for automatically controlling an operation of an appliance, said pilot burner comprising:

a body defining a mixing chamber for the gas and primary air, said body including an axial bore leading to said mixing chamber, a gas injector opening into said mixing chamber for an introduction of gas axially in said mixing chamber opposite to said axial bore, and a primary-air intake port made in a wall of said body for an intake of primary air radially into said mixing chamber;

an open tube including a first end which penetrates axially into said mixing chamber through said bore, said first end including a bevelled inclined-edged orifice which is located radially opposite to said primary-air intake port and also axially opposite to said gas injector such that gas from said gas injector passes axially into said inclined-edged orifice and primary air passes radially into said inclined-edged orifice, and a second end axially distal from said body where the gas and primary air mixed in said first end are burned; and an adjustable fixing means for adjustably fixing said tube axially in said bore of said body while allowing an angular orientation of said bevelled orifice with respect to said port to be adjusted to control a level of primary air intake radially into said mixing chamber without affecting a level of axial gas introduction.

2. An atmosphere-control pilot burner as claimed in claim 1:

wherein said axial bore is coaxial with said gas injector opening; and wherein said fixing means is a force fitting of said tube in said bore.

3. An atmosphere-control pilot burner as claimed in claim 2 wherein said tube is a metal blank rolled edge-to-edge.

4. An atmosphere-control pilot burner as claimed in claim 2 wherein said first end of said tube includes a longitudinal peg which acts as an axial stop engaging a bottom of said bore to properly position said intake port radially opposite said bevelled orifice.

5. An atmosphere-control pilot burner as claimed in claim 1 wherein said second end of said tube includes a main-flame orifice which creates a main flame, and a pilot-flame orifice located laterally with respect to said main-flame orifice which creates a pilot flame adjacent a root of a main flame.

6. An atmosphere-control pilot burner as claimed in claim 5 wherein said pilot-flame orifice is annular and surrounds said main-flame orifice.

7. An atmosphere-control pilot burner as claimed in claim 6 wherein said tube includes a coaxial tubular insert located in said second end, said tubular insert having a central orifice which forms said main-flame orifice and being separated from a wall of said second end by an annular space which annular space forms said pilot-flame orifice.

8. An atmosphere-control pilot burner as claimed in claim 7 wherein a radial cross section of said tubular insert is selected in accordance with a type of gas to be mixed and burned.

* * * * *